US006590488B2

(12) United States Patent
Marcotte

(10) Patent No.: US 6,590,488 B2
(45) **Date of Patent: *Jul. 8, 2003**

(54) CONFIGURABLE TRANSFORMER

(75) Inventor: Laurent Marcotte, Laigne (FR)

(73) Assignee: Vishay S.A. (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/482,482

(22) Filed: Jan. 12, 2000

(65) Prior Publication Data

US 2003/0001706 A1 Jan. 2, 2003

(30) Foreign Application Priority Data

Jan. 12, 1999 (FR) ..... 99 00241

(51) Int. Cl.[7] ..... H01F 27/29

(52) U.S. Cl. ..... 336/192; 336/83; 336/200; 336/232

(58) Field of Search ..... 336/232, 200, 336/184, 107, 198, 192, 83

(56) References Cited

U.S. PATENT DOCUMENTS 3,395,336 A 7/1968 Weeman
5,184,103 A * 2/1993 Gadreau et al. ..... 336/180
5,886,519 A * 3/1999 Masreliez et al. ..... 324/207.17
5,952,909 A * 9/1999 Umeno et al. ..... 336/192
6,000,128 A * 12/1999 Umeno et al. ..... 29/846

FOREIGN PATENT DOCUMENTS

| | | |
|---|---|---|
| DE | 1915984 | 10/1970 |
| DE | 2402016 | 7/1975 |
| EP | 0762446 A1 | 3/1997 |
| FR | 1543428 | 10/1968 |
| FR | 2406908 | 5/1979 |
| GB | 211553 | 2/1924 |

* cited by examiner

*Primary Examiner*—Tuyen T. Nguyen
(74) *Attorney, Agent, or Firm*—Bachman & LaPointe, P.C.

(57) ABSTRACT

The present invention relates to a current and/or voltage transformer comprising at least one primary circuit P and one secondary circuit S. The transformer according to the invention comprises m elementary windings each having Ni turns, m and Ni being integer numbers, and i lying between 1 and a predetermined integer number n, said groups of elementary windings being capable of being associated in series and/or in parallel in such a way as to produce a particular configuration from among a plurality of distinct configurations of primary circuits P and of secondary circuits S each of said configurations corresponding to previously fixed electrical and magnetic parameters.

9 Claims, 5 Drawing Sheets

CONFIGURABLE TRANSFORMER

BACKGROUND OF THE INVENTION

1. Field of the Invention

The present invention relates to a current and/or voltage transformer comprising at least one primary circuit and one secondary circuit and more particularly to a transformer which, through its configurable character, can be used in several different electrical supplies.

As a function of the parameters of the supply (topology, input voltages, output voltages, chopping frequency etc.) the variable parameters of this transformer can be configured so as to tailor the "standard" transformer to this specific application. These variable parameters are: the number of windings, the number of turns per winding and also their resistance. These latter are configurable over a range of discrete values depending on the design of tile transformer.

2. Description of the Prior Art

Customarily, each supply has its specific transformer. The number of windings as well as the number of turns and the resistance value of each winding are determined so as to cater for the particular function. The transformer is totally unadaptable and consequently virtually dedicated to this supply. With each supply, a specific transformer must be designed, engineered and produced. The same is true for the inductor which is a particular case of the transformer.

SUMMARY OF THE INVENTION

The objective of this invention is to produce a "standard" transformer which can be configured as a function of the parameters of the supply in which it is intended to be mounted.

The transformer according to the invention comprises m elementary windings each having Ni turns, i being an integer number lying between 1 and a predetermined integer number n, m and Ni being integer numbers, said elementary windings being capable of being associated in series and/or in parallel in such a way as to produce a particular configuration from among a plurality of distinct configurations of primary circuits and of secondary circuits, each of said configurations corresponding to previously fixed electrical and magnetic parameters.

Thus, during the design of a supply, the design of the transformer is replaced by a simple configuration of the "standard" product. A single product is to be engineered and to be manufactured, thereby considerably reducing the cost of the magnetic components.

Preferably, said groups of elementary windings are constituted by a multilayer printed circuit block exhibiting a sandwich structure constituted by superposing a plurality of layers of copper arranged between two semi-ferrites forming the magnetic circuit of the transformer, said layers being separated by insulating layers.

According to a preferred characteristic of the invention, the electrical connections between the groups of elementary windings are etched on the printed circuit intended to receive the transformer.

BRIEF DESCRIPTION OF THE DRAWINGS

Other characteristics and advantages of the invention will emerge from the description which follows, taken by way of non-limiting example, with reference to the appended figures in which.

DETAILED DESCRIPTION OF THE PREFERRED EMBODIMENTS

Figure 1:
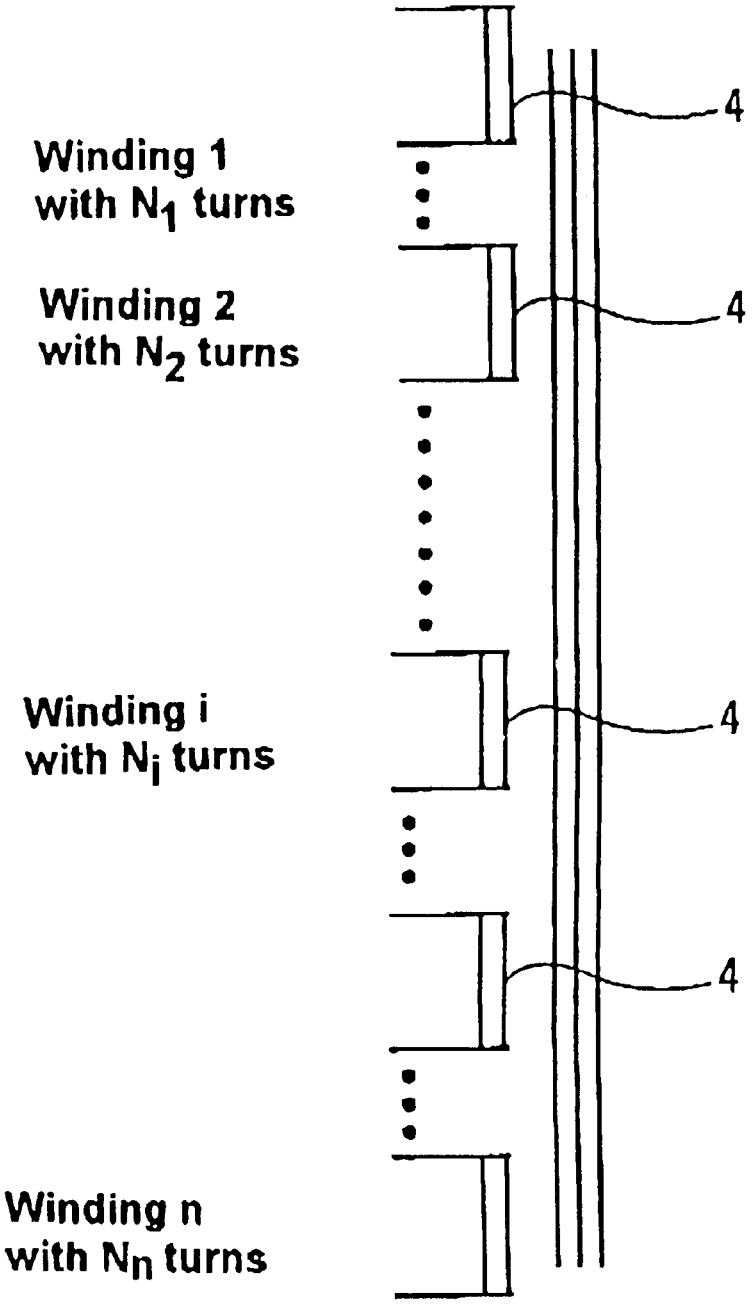
FIG. 1 represents a schematic diagram of a transformer according to the invention.

As represented in FIG. 1, the transformer 2 is composed of m windings 4 each having Ni turns, i being a natural integer lying between 1 and a predetermined integer number n defining a family of windings of Ni turns, m and Ni being natural integers. These windings are intended to constitute at least one primary circuit P and at least one secondary circuit S of the transformer 2. The windings of each group are referred to as elementary windings in the subsequent description.

The elementary windings 4 are capable of being associated in series and/or in parallel in such a way as to produce a particular configuration from among a plurality of distinct configurations of primary circuits and of secondary circuits. Each of said configurations corresponding to previously fixed electrical and magnetic parameters in respect of the transformer to be produced. The number of configurations depends on m and on the family of the Ni windings. For example, by connecting two windings with respectively two and three turns in series, a single winding with five turns is obtained. Likewise, by connecting in parallel two windings with three turns having respective resistances R and R', a single winding with three turns and resistance $R*R'/(R+R')$ is obtained.

A group of elementary windings 4 can be composed of one to m−1 elementary windings, terminals included. It follows that the number of windings of the configured transformer 2 lies between 2 and m (terminals included) depending on the configuration chosen.

According to a particular application of the invention, when the number of windings is equal to 1, an induction coil is obtained, comprising a main winding, constituted by associating in series and/or parallel at least two elementary windings 4 each having a determined number of turns.

According to an important characteristic of the invention, the electrical and/or magnetic parameters of said transformer 2 and of the induction coil are configurable through choice of the number and of the mode of association of the elementary windings.

Thus, the number of turns of each group of elementary windings is configured through:

the number of elementary windings of this group, the respective number of turns of each elementary winding, and through the nature of the various connections between these elementary windings.

The number of turns of a group of elementary windings of the transformer lies between Inf. (Ni) and Σ Ni.

By configuring the number of turns of the windings, the transformation ratio is configured since it is equal to the ratio of the numbers of turns.

The resistance of each group of windings 4 is configured through:

the number of elementary windings of this group, the resistance of each elementary winding, and the nature of the various connections between these elementary windings.

The resistances of the windings of the configured transformer 2 ran be calculated on the basis of the resistances of the elementary windings with the aid of the laws of physics.

Figure 2:
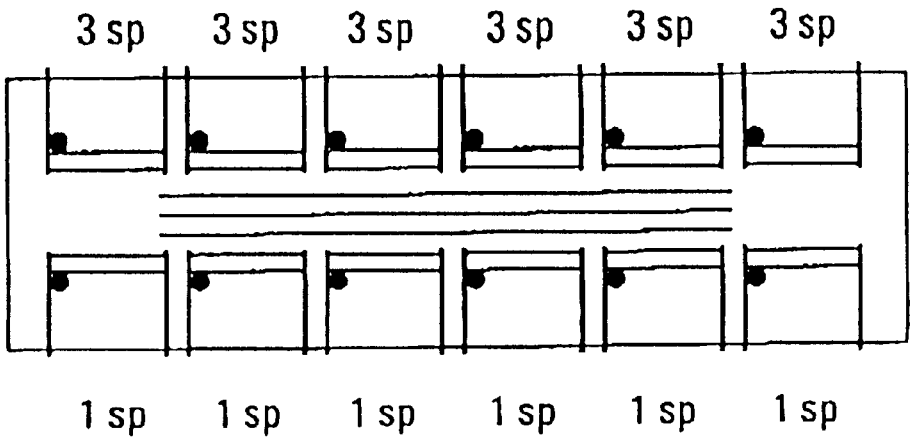
FIG. 2 represents the structure of an exemplary transformer according to the invention.

FIG. 2 illustrates an exemplary application in which:

m=12

$N_1=N_2=N_3=N_4=N_5=N_6=3$ $N_7=N_8=N_9=N_{10}=N_{11}=N_{12}=6$

Figure 3:
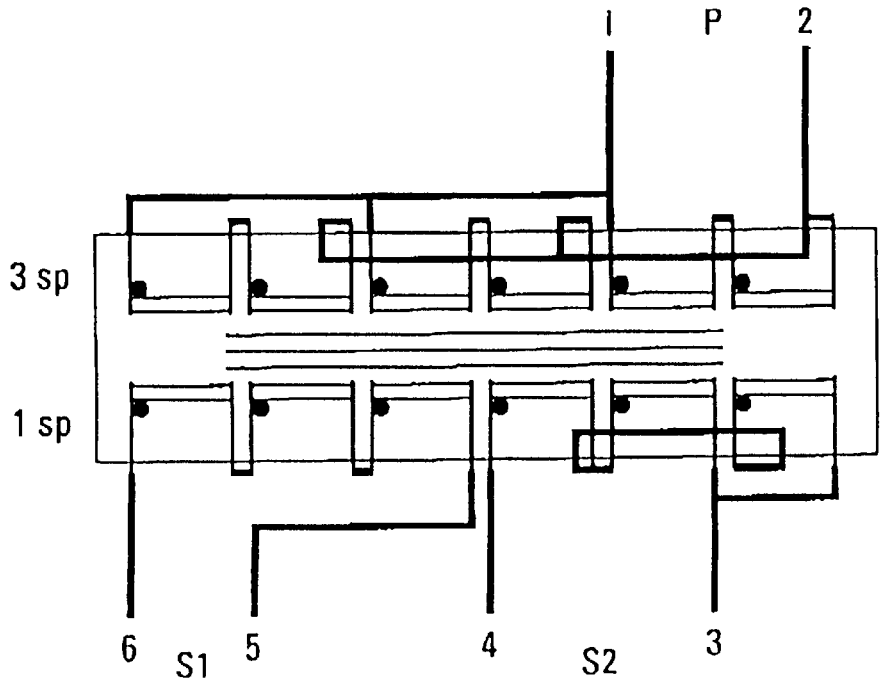
FIG. 3 illustrates diagrammatically the electrical connections of a first configuration of a transformer on the basis of the structure of FIG. 2.
Figure 4:
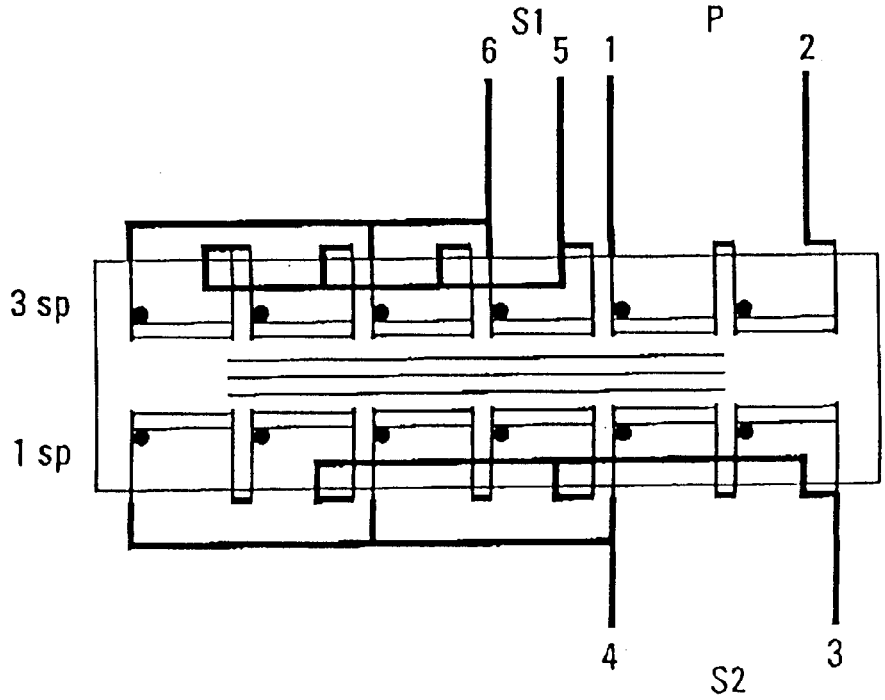
FIG. 4 illustrates the electrical connections of a second configuration of a transformer according to the invention on the basis of the structure of FIG. 2.

By assuming in this example that the resistances of the windings with three turns are identical and equal to 70 Ω and that the resistances of the windings with one turn are identical and equal to 10 mΩ, the structure shown diagrammatically by FIG. 2 is obtained, on the basis of which the configurations illustrated by FIGS. 3 and 4 are produced.

Figure 5:
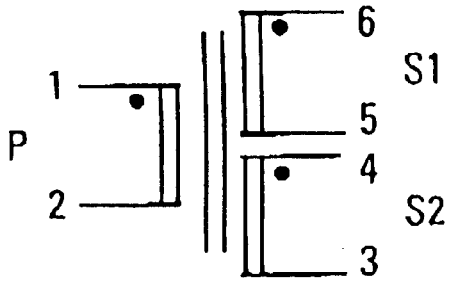
FIG. 5 illustrates an electrical diagram of an example of a transformer according to the invention having a primary circuit and two secondary circuits.

By assuming that the desired transformer possesses three windings P, S1 and S2 having respectively six, three and two turns with the phases corresponding to the electrical diagram of FIG. 5, FIGS. 3 and 4 represent two exemplary configurations meeting the requirement.

With the first configuration (FIG. 3), we obtain:

$R_p$=(2*70)/3 mΩ i.e. around 46.7 mΩ

$Rs_1$=3*10=30 mΩ

$Rs_2$=10+10/2=15 mΩ

Whereas with the second configuration (FIG. 4), we obtain:

$R_p$=2*70=140 mΩ

$Rs_1$=70/4=17.5 mΩ

$Rs_2$=20/6 mΩ i.e. around 1.67 mΩ

This example demonstrates the possibility of configuring the number of windings, the number of turns and the resistance of each winding.

Preferably, the configurable transformer 2 physically comprises a considerable number of windings since it conditions the number of combinations.

Figure 6:
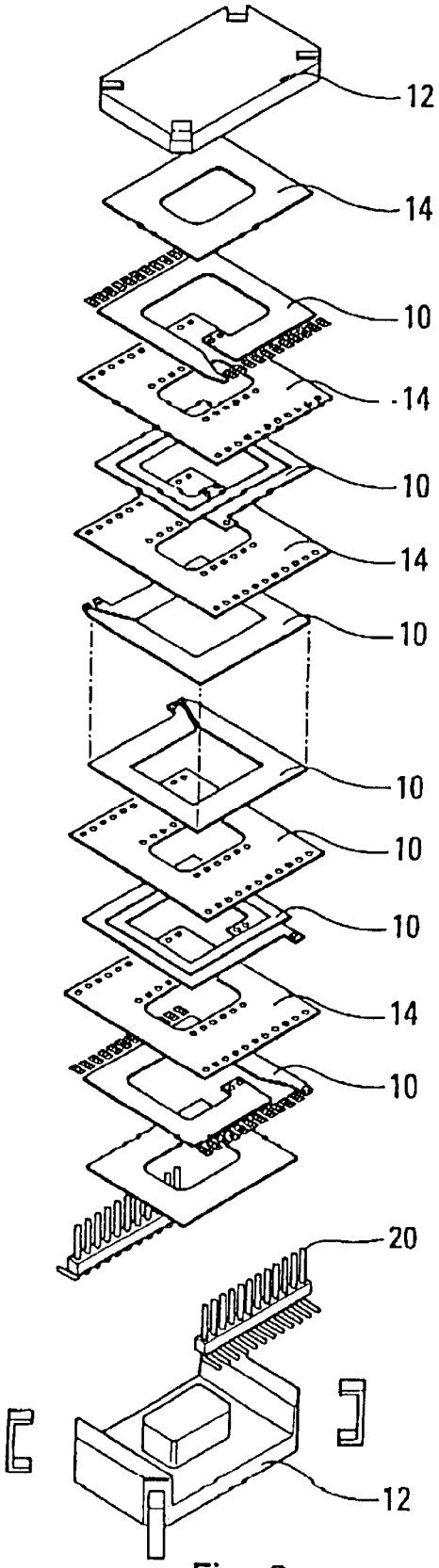
FIG. 6 represents an exploded view of a transformer according to the invention.
Figure 7:
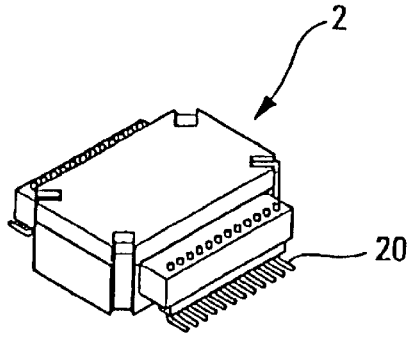
FIG. 7 represents a perspective view of a transformer according to the invention.
Figure 8:
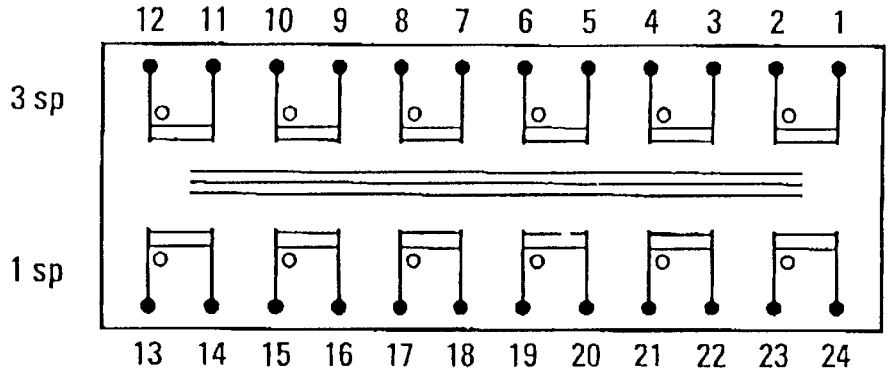
FIG. 8 illustrates a bottom view of the physical layout of the transformer of FIG. 4.

The technology of the coil can be any of the known coiling technologies such as, for example:

the linear or toric wire technology the rigid or flexible printed circuit multilayer technology the multilayer ceramic technology According to a preferred embodiment of the invention, illustrated by FIGS. 6 and 7, for a plug-in or SMC version, the coil is constituted by a multilayer printed circuit block. Said groups of elementary windings are constituted by superposing a plurality of copper layers 10 arranged between two semi-ferrites 12 forming the magnetic circuit of the transformer 2, said copper layers 10 being separated by insulating layers 14.

Figure 9:
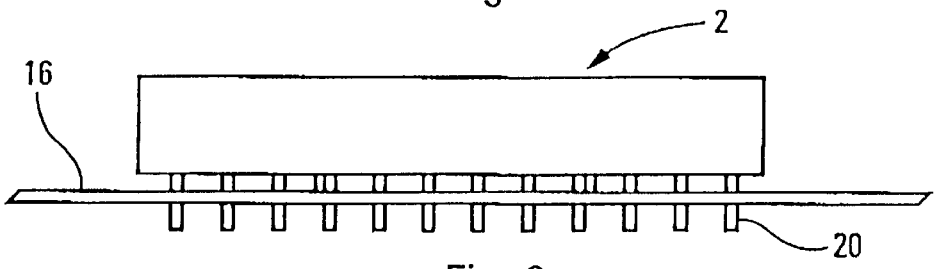
FIG. 9 illustrates a profile view of a transformer according to the invention mounted on a printed circuit of an electrical supply.
Figure 10:
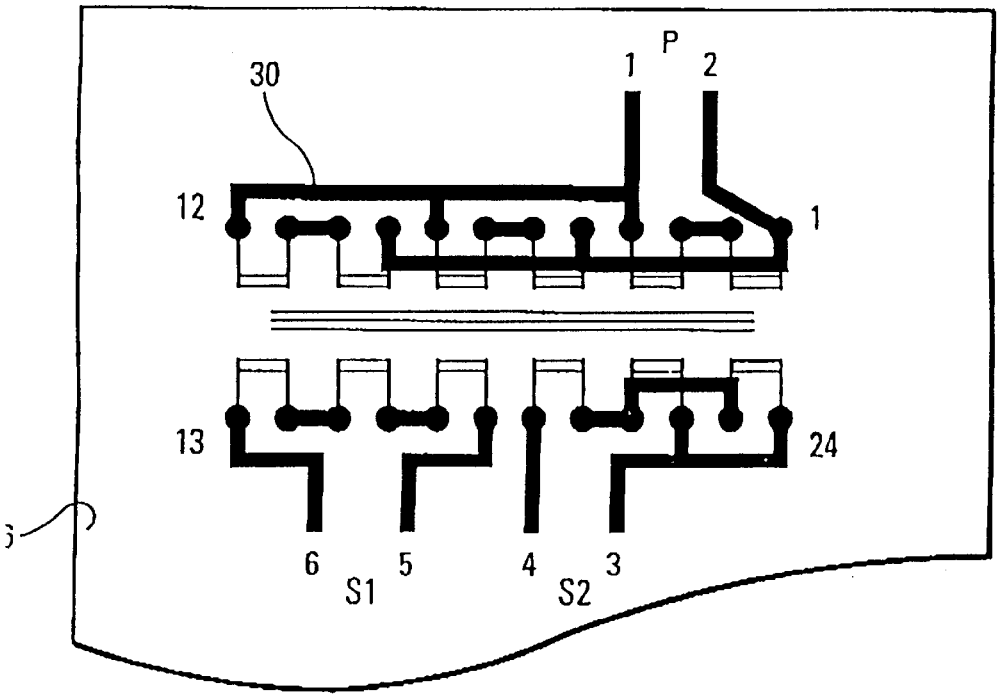
FIG. 10 illustrates a bottom view of FIG. 9.

In this embodiment, the electrical connections between the groups of elementary windings are preferably etched on the printed circuit 16 intended to receive the transformer as may be seen in FIGS. 9 and 10.

Thus, the user of the transformer can himself configure it by planning the connection tracks during the CAD phase of the printed circuit of the electrical supply. The cost and the volume of connections of this type are virtually zero.

This technology allows very good coupling between elementary windings even if their respective number of turns is small.

According to other embodiments which are not represented, the connections may be for example wire connections (conducting wires electrically linking the various input/output pins of the elementary windings).

Assuming that the desired electrical configuration is that represented by FIG. 3, the physical layout of the transformer is illustrated by FIG. 10.

As is illustrated by this FIG. 10, the connections between elementary windings are effected through copper tracks 30 etched on the printed circuit 16 of the electrical supply.

What is claimed:

1. A winding assembly forming an electromagnetic circuit, said electromagnetic circuit comprising:

2×m connection terminals, m independent elementary windings disconnected from each other, each elementary windings having Ni turns connected to two respective internal connection terminals, said two internal connection terminals of each of said elementary windings being connected to two respective external connection terminals of said assembly, m and Ni being integer numbers, and i lying between 1 and a predetermined integer number n, and external connection means connecting said external connection terminals of said assembly so as to form groups of elementary windings connected in series and/or in parallel and constitute an electromagnetic circuit comprising at least one winding having previously fixed electrical and magnetic features.

2. The winding assembly as claimed in claim 1, wherein the electrical and magnetic features of said assembly are configurable by choosing said external connection means which determine a number of the elementary windings interconnected in said electromagnetic circuit and mode of connection in series and/or in parallel of the elementary windings performed by said external connection means in said electromagnetic circuit.

3. The winding assembly as claimed in claim 2, wherein each of said group of elementary windings has a number of turns which is determined by a number of said elementary windings interconnected in the group by said external connection means, by the number of turns of each elementary winding interconnected in the group and by the mode of connection in series and/or in parallel of the elementary windings of the group.

4. The winding assembly as claimed in claim 3, wherein the number of turns of each of said groups of elementary windings of the winding assembly lies between a lowest value of the number of turns of the elementary windings of the group and a sum of the number of turns of each elementary windings of the group, depending on said external connection means connecting in series and/or in parallel the elementary windings of the group.

5. The winding assembly as claimed in claim 1, wherein each group of elementary windings has a resistance which is determined by the number of elementary windings of the group, the resistance of each elementary winding of the group and of the external connection means interconnecting the terminals of the elementary windings of the group.

6. The winding assembly as claimed in claim 1, further comprising an electrically insulating layer between each of said elementary windings for insulating said elementary windings from each other.

7. The winding assembly as claimed in claim 1, having a multi-layered structure comprising a plurality of layers, each said layer supporting at least one of said elementary windings.

8. The winding assembly as claimed in claim 1, wherein said external connection means interconnect said elementary windings so as to form groups of elementary windings connected in series and/or in parallel so as to constitute at least two windings forming respectively at least one primary circuit and at least one secondary circuit of a transformer having previously fixed electrical and magnetic features.

9. The winding assembly as claimed in claim 1, wherein said at least one winding forms and induction coil having previously fixed electrical and magnetic features.

* * * * *